US005775647A

United States Patent [19]

Wyatt

[11] Patent Number: 5,775,647

[45] Date of Patent: Jul. 7, 1998

[54] HYDRAULIC SWITCH STAND

[76] Inventor: Michael L. Wyatt, 6455 Muirfield Dr., Paducah, Ky. 42001

[21] Appl. No.: 792,493

[22] Filed: Jan. 31, 1997

[51] Int. Cl.[6] ..... B61L 7/04

[52] U.S. Cl. ..... 246/258; 246/393

[58] Field of Search ..... 246/257, 258, 246/285, 393, 407

[56] References Cited

U.S. PATENT DOCUMENTS

| | | | |
|---|---|---|---|
| 3,015,464 | 1/1962 | Bush | 246/258 |
| 3,553,449 | 1/1971 | Hathaway | 246/3 |
| 4,066,228 | 1/1978 | Elder | 246/5 |
| 4,428,552 | 1/1984 | Frank et al. | 246/258 |
| 4,570,543 | 2/1986 | Ishikura et al. | 104/300 |
| 4,655,421 | 4/1987 | Jaeger | 246/167 R |
| 5,073,750 | 12/1991 | Coron | 246/167 R |
| 5,085,148 | 2/1992 | Konno | 104/130 |
| 5,292,091 | 3/1994 | Callegari et al. | 246/258 |
| 5,293,892 | 3/1994 | Fourqurean | 137/3 |
| 5,417,392 | 5/1995 | Wyatt | 246/257 |
| 5,470,035 | 11/1995 | Sargis | 246/221 |

FOREIGN PATENT DOCUMENTS

| | | |
|---|---|---|
| 521171 | 12/1976 | U.S.S.R. . |
| 1643274 A1 | 4/1991 | U.S.S.R. . |

OTHER PUBLICATIONS

Fenner Fluid Power—Distributor Unit—Service Parts List (Jul. 12, 1993).

*Primary Examiner*—S. Joseph Morano

*Attorney, Agent, or Firm*—A. M (Andy) Arismendi, Jr.; Jenkens & Gilchrist

[57] ABSTRACT

An apparatus is provided for moving railroad switch points from side-to-side using a hydraulic power source operated using a DC electrical power source preferably in combination with a solar energy charging system. The apparatus has a hydraulic cylinder with a piston operatively connected to the switch points to move the switch points from side-to-side. The hydraulic power source is in fluid communication with the hydraulic cylinder. A valve for controlling the direction of the movement of the switch points by altering the direction of flow of hydraulic fluid is positioned in fluid communication between the hydraulic power source and the hydraulic cylinder. Preferably, the hydraulic power source is a hydraulic pump operated by a DC electric motor drawing power from a battery. The electrical charge of the battery is preferably replenished or supplemented by use of the solar energy charging system. The solar energy system has at least one solar panel electrically connected to a battery charge regulator which in turn is electrically connected to the battery. The piston and connecting rod are operatively attached to a pivot shaft such that movement of the operating rod along its axis causes a rotation of the main pivot shaft, which translates to movement of the connecting rod along its axis to effect switching of the switch points. A biasing spring is also connected to the pivot shaft to assist in the retraction or extension of the connecting rod and locking it in the extended or retracted position.

7 Claims, 6 Drawing Sheets

HYDRAULIC SWITCH STAND

BACKGROUND OF THE INVENTION

1. Field of the Invention

The present invention relates to a railroad switch and particularly to a hydraulic switch stand for a railroad turnout to divert trains from one track to another.

2. Description of Related Art

Railroad turnouts divert trains from one track to another. The major components of a turnout are the switch, a frog, a pair of guard rails (when required), a throwing device, stock rails, closure rails, and turnout rails. Frogs allow wheel flanges to cross opposing rails in turnouts and crossings, while providing support for the wheels. A switch consists of two moveable point rails called "switch points." Switch points are presently thrown from one track position to the other track position through mechanical connections either manually by a switch stand, or by a remotely controlled throwing device. In either position, one of the switch points fits against a fixed rail called a "stock rail." Safe railroad operation depends on the quality of this fit and the security with which the switch is held in this position by the throwing mechanism in the switch rods.

A switch rod connects the right and left-hand switch point so that they both move simultaneously and that they maintain the proper position with respect to one another. The guard rail consists of a rail laid parallel to the running rails of a track. The guard rail is used to hold wheels in alignment to guide the flange of the wheels safely past the point of the frog. State of the art switch stands are called the "Model 51 New Century" which have been in use since the early 1900's. This type of switch stand uses a weighted throw lever which assures positive closing of the switches when engaged with the foot latches. Unfortunately, this type of switch stand requires intense ergonomic effort to throw the railroad switch which causes several hundred injuries a year. For almost 100 years this drudgery has persisted.

Others have attempted to replace this antiquated equipment with hydraulic power, generated by a hydraulic motor driven by AC electric power, often impossible due to the remoteness of location and usually at extra expense associated with the running of AC electric power thereto. AC power also adds another element of danger, i.e., electrocution. Rather than using AC electric power, my earlier invention disclosed in U.S. Pat. No. 5,417,392 utilized a hydraulic rail pump and an accumulator for storing hydraulic power generated by the rail pump activated by the wheels of passing trains. In areas with low rail traffic, situations may arise where insufficient hydraulic power is generated and stored for operation of the switch. Further, in such situations, hydraulic systems may be subject to a slow loss of pressure and therefore be unable to maintain the required amount of stored hydraulic power for switch operation. Therefore, it is an objective of the present invention to provide a hydraulically operated switch stand that is safe to use, operates on a cheap energy source and eliminates extensive physical effort by personnel. Further, such a system would be designed to give many years of maintenance free service.

SUMMARY OF THE INVENTION

The present invention relates to an apparatus for moving railroad switch points from side-to-side using a hydraulic power source operated using a DC electrical power source preferably in combination with a solar energy charging system. The apparatus has a hydraulic cylinder with a piston operatively connected to the switch points to move the switch points from side-to-side. The hydraulic power source is in fluid communication with the hydraulic cylinder. A valve for controlling the direction of the movement of the switch points by altering the direction of flow of hydraulic fluid is positioned in fluid communication between the hydraulic power source and the hydraulic cylinder.

In one aspect of the invention, the hydraulic power source is a hydraulic pump operated by a DC motor drawing power from a battery. In the preferred embodiment, the electrical charge of the battery is replenished or supplemented by use of the solar energy charging system. The solar energy system has at least one solar panel electrically connected to a battery charge regulator which in turn is electrically connected to the battery. The hydraulic pump continues to operate until the hydraulic pressure reaches a predetermined maximum for the hydraulic system, setting off a pressure switch which disconnects the DC motor from the DC power source. The hydraulic pump may be turned on and off by use of a local switch and/or by remote control, e.g., infrared or radio control.

The hydraulic cylinder has a piston which may be moved by use of hydraulic fluid in one of two directions depending on which side of the piston the hydraulic fluid is introduced to the hydraulic cylinder. To the piston is connected an operating rod which extends beyond the hydraulic cylinder. There is also provided a pivot shaft, pivotally mounted to a mounting structure. The pivot shaft has a first tab, a second tab and a third tab, with each of the tabs extending perpendicular to the axis of the shaft. One end of the connecting rod is pivotally mounted to the free end of the first tab. One end of the operating rod is attached to the piston and the other end is pivotally connected to the second tab. Movement of the operating rod along its axis causes a rotation of the main pivot shaft, which translates to movement of the connecting rod along its axis. The connecting rod is operatively connected to the switch ponits. By extending or retracting the operating rod, the connecting rod is moved axially to effect switching of the switch points. The third tab may be connected to biasing spring to assist in the retraction or extension of the connecting rod. The spring may also be used for locking the connecting rod in position when the operating rod has been extended or retracted. The spring aids the hydraulic cylinder in the extension or retraction of the connecting rod and also provides the function of locking same into position, for example, when the switching is completed and the hydraulic pressure is relieved or if hydraulic pressure should fail.

More particularly, there is provided an apparatus for moving railroad switch points from side-to-side, the apparatus comprising a pivot shaft; a connecting rod having a first end operatively connected to the pivot shaft and a second end operatively attached to the switch points such that movement of the connecting rod along its axis moves the switch points from side-to-side; a hydraulic cylinder having an operating rod that has a first end operatively connected to the pivot shaft and a second end connected to a piston internally disposed in the hydraulic cylinder, the piston defining a portion of two separate pressurizeable chambers within the hydraulic cylinder; a hydraulic power source in fluid communication with the pressurizeable chambers in the hydraulic cylinder; a valve positioned in fluid communication between the hydraulic power source and each of the pressurizeable chambers in the hydraulic cylinder for selectively controlling the direction of movement of the operating rod of the hydraulic cylinder; a biasing spring having a first end pivotally attached to a fixed point and a second end operatively attached to the pivot shaft, wherein movement of the operating rod along its axis causes a rotation of the main pivot shaft, which translates to movement of the connecting rod along its axis to effect switching of the switch points from side-to-side and wherein the biasing spring exerts a force against its connection to the pivot shaft to assist in the retraction or extension of the connecting rod and to lock the connecting rod in position after the operating rod has been extended or retracted.

There is also provided an apparatus for moving railroad switch points from side-to-side, the apparatus comprising a hydraulic cylinder having an operating rod that has a first end operatively connected to the switch points to move the switch points from side-to-side and a second end connected to a piston internally disposed in the hydraulic cylinder, the piston defining a portion of two separate pressurizeable chambers within the hydraulic cylinder; a hydraulic power source in fluid communication with the pressurizeable chambers in the hydraulic cylinder, wherein the hydraulic power source at least includes a hydraulic pump, a DC electric motor, and a battery having a stored electrical charge; a valve positioned in fluid communication between the hydraulic power source and each of the preizeable chambers in the hydraulic cylinder for selectively controlling the direction of movement of the operating rod of the hydraulic cylinder; and a solar energy charging system, wherein the solar energy charging system replenishes the electrical charge of the battery, and wherein the hydraulic pump is mechanically connected to and driven by the DC electric motor and the DC electric motor is electrically connected to the battery for drawing the stored electrical charge from the battery.

BRIEF DESCRIPTION OF THE DRAWINGS

The accompanying drawings, which are incorporated in and form a part of this specification, illustrate the embodiments of the present invention and, together with a description, serve to explain the principles of the invention. In the drawings.

It is to be noted that the drawings illustrate only typical embodiments of the invention and are therefore not to be considered limiting of its scope, for the invention will admit to other equally effective embodiments.

DETAILED DESCRIPTION OF THE INVENTION

The hydraulic switch stand of the present invention is attached to the switch rods of conventional switch points either on railroad yards or in a long line situation just as the present antiquated switch stands are used. One great advantage of the practice of the present invention is that the switch stands may be changed with only minor modifications of the system. The foot print of the switch stand of the present invention can be tailored to fit the approximate foot print of present switching devices with the operating rod of the hydraulic cylinder of the switch stand of the present invention replacing the attachment of the connecting rod in the present "new century" switch stands. Another advantage of the present invention is that the switch stand can be operated now by pushing a button rather than the backbreaking 180 degree(s) movement of the mechanical switch stands currntly in vogue. Further, it does not require an AC energy source. Rather, a DC power source, e.g., a battery, which is recharged using a solar charging system.

Figure 1:
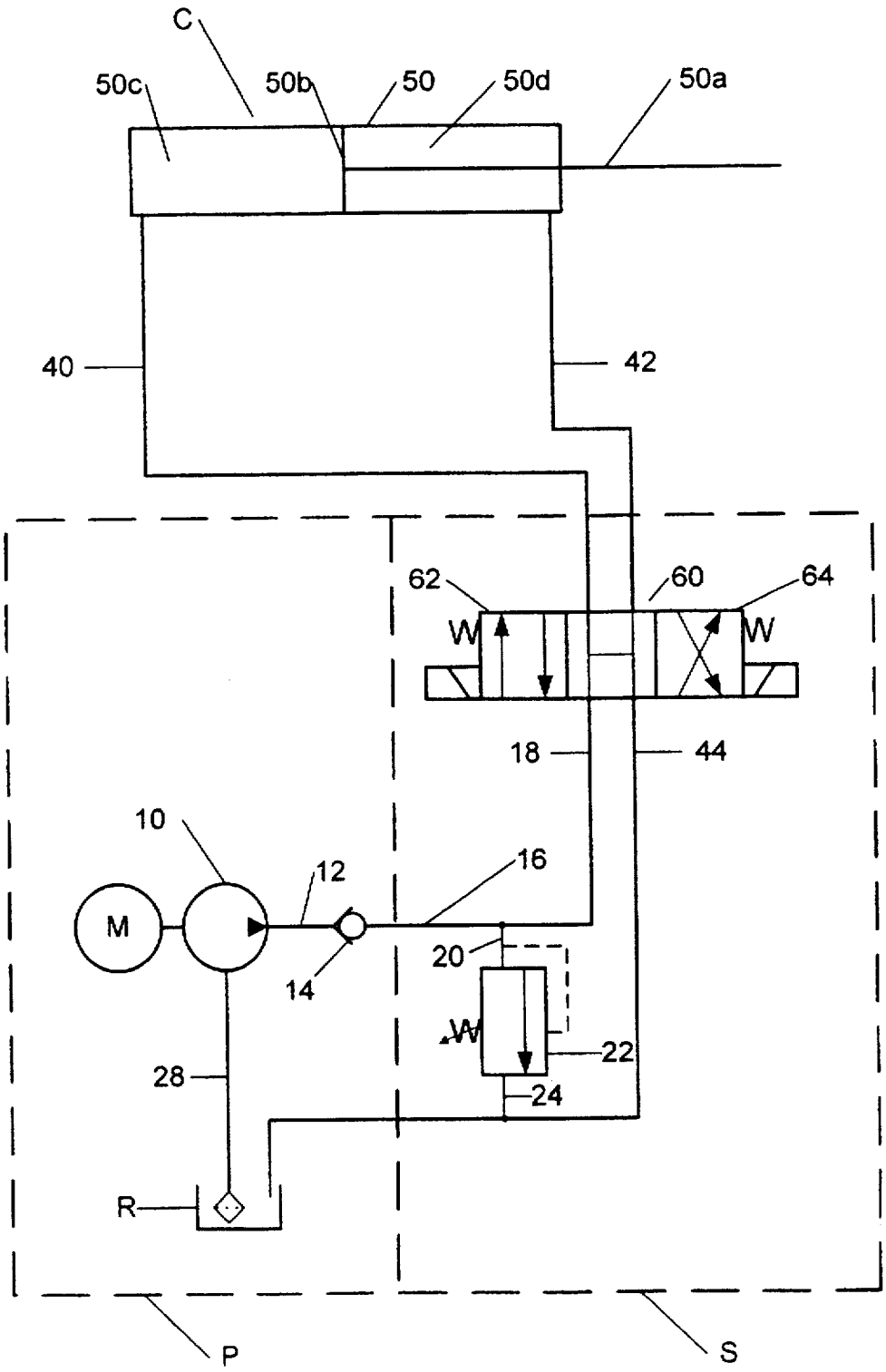
FIG. 1 is a diagram of the hydraulic system in schematic form for an embodiment of the switch stand of the present invention.
Figure 3:
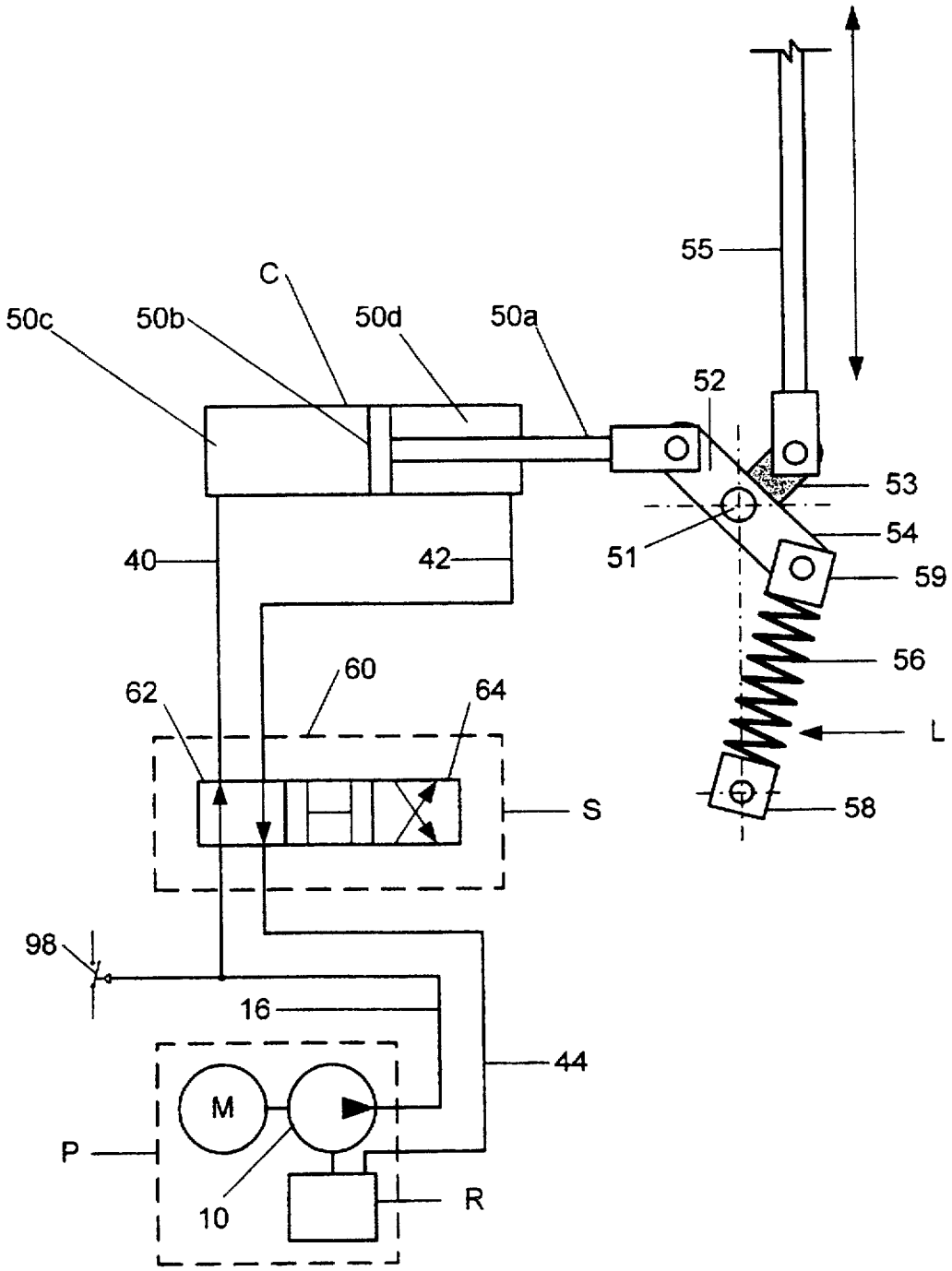
FIG. 3 is a simplified drawing showing the pivot shaft in a first position with the directional valve in a position to effect rotation of the pivot shaft to a second position (as shown in FIG.4).
Figure 4:
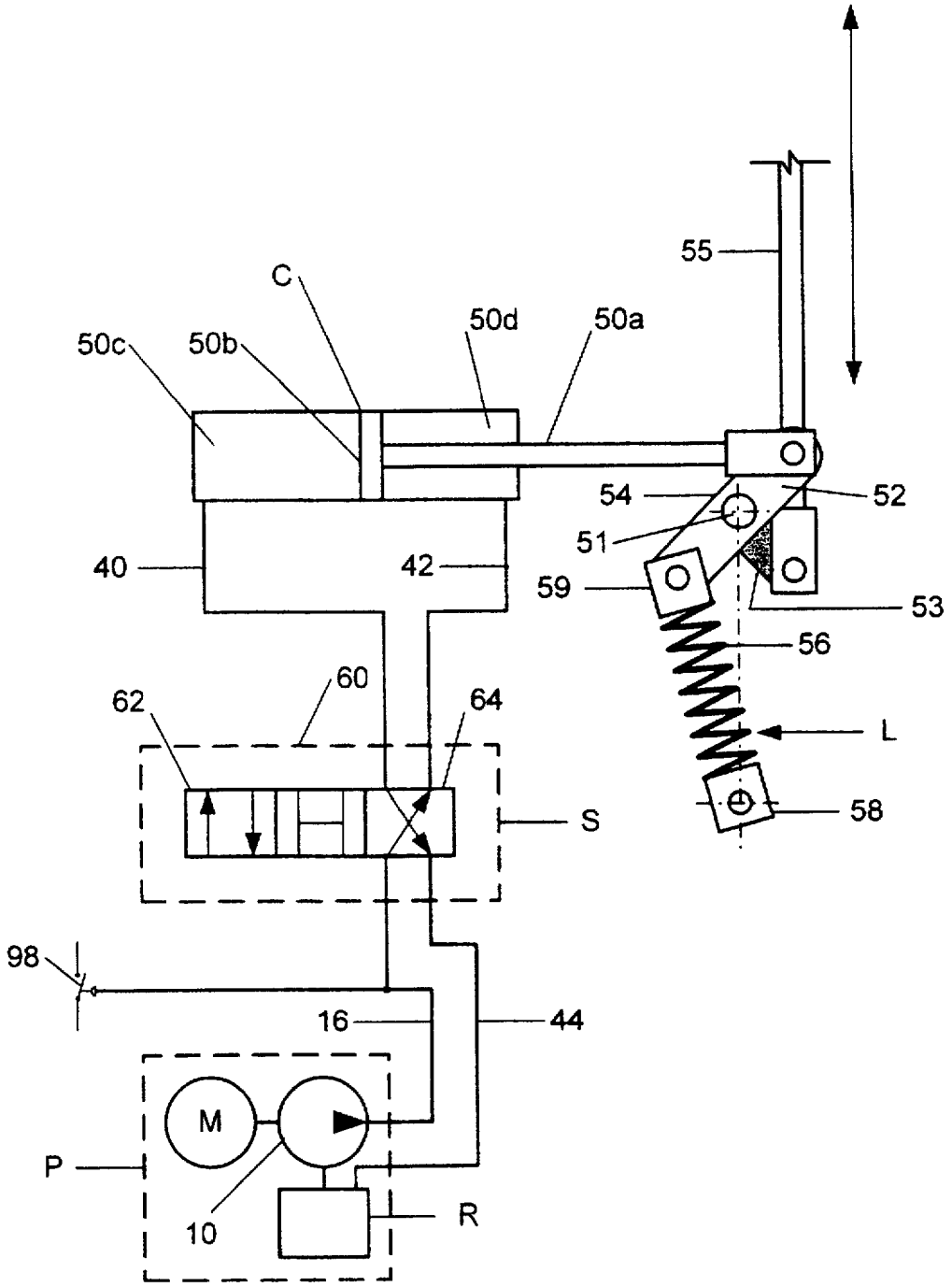
FIG. 4 is a simplified drawing showing the pivot shaft in the second position with the directional valve in a position to effect rotation of the pivot shaft to the first position (as shown in FIG. 3).

The invention will be more clearly understood by referring to FIG. 1 which is a schematic diagram of the hydraulic flow system for a switch stand according to the present invention. FIG. 1 shows generally the system S which directs the flow of hydraulic fluid to open or close a switch in response to a hydraulic cylinder C. Hydraulic cylinder C is in fluid communication with a power source P which is a hydraulic pump operated by a DC motor M. The rod of the hydraulic cylinder C is attached to the connecting rod or switch rods commonly used to open or close a normal switch point in anticipation of the direction to which an oncoming train should be sent. This hydraulic cylinder moves the switch rods in response to pressure of the hydraulic fluid flowing through the system to be described. As shown in FIGS. 3 and 4, there is also provided a biasing spring which also serves as part of lock L to secure the operating rod of the hydraulic cylinder C in the desired position to guard against any change in position of the switch by virtue of ceasing switching operations or by virtue of fluid leakage or some other malfunction.

Figure 2A:
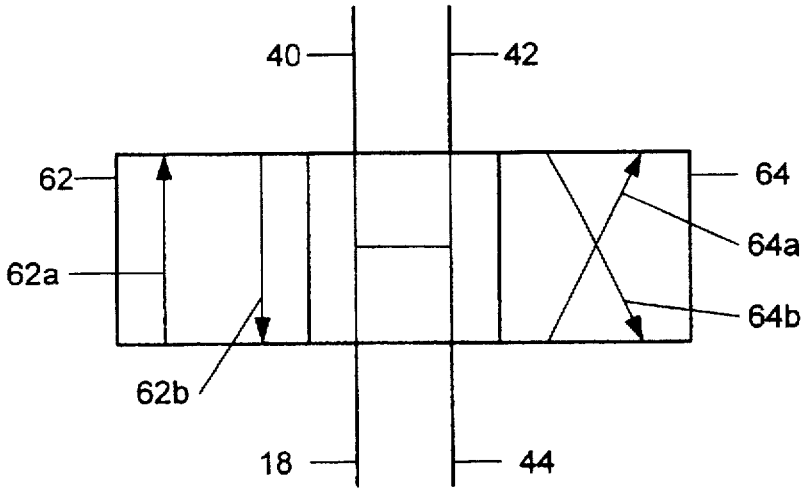
FIG. 2*a* is a schematic diagram showing the direction control valve in its neutral position.

As a more specific discussion of the system of this invention from FIG. 1, the great advantage of the system of this invention is the lack of necessity to run an AC power source to the location of the switch and the ability of this system to operate the switch using energy harnessed from the sun and stored in a battery. In order to do this, the hydraulic power source P is equipped with a hydraulic pump 10 which is operated by a DC motor M. The pressurized hydraulic fluid exits through line 12 through check valve 14 into line 16 and branches 18 and 20. In the event that the pressure in branch 20 exceeds a set point, valve 22 operates such that upon the moving hydraulic fluid in line 16 is diverted from branch 18 to branch 20 through pressure relief valve 22 and hence to branch 24 and line 26 to reservoir R. After switching is complete, valve 60 is positioned in a neutral position (see FIG. 2*a*) which provides run through protection. A run through is when a train travels through the switch points when they are lined up for the other track. The result is that the force of the locomotive and cars force the switch points over and thus damage the internal workings of the prior mechanical stand by bending or breaking some of the switch mechanism. The hydraulic switch stand of the present invention will allow the train to force the points to the opposite side by passing the fluid over the "H" pattern of valve 60 to the reservoir R when the valve 60 is in the neutral position as shown in FIGS. 1 and 2*a*. Since the hydraulic fluid is in effect a safety fuse, no damage is done to any of the mechanical components.

Reservoir R is preferably at low pressure, e.g., atmospheric pressure. A function of the reservoir R is to supply hydraulic fluid through line 28 to pump 10. On completion of the pumping stroke of pump 10 or in a run through situation as noted above, the check valve 14 closes to prevent flow of hydraulic fluid back toward the pump 10.

The hydraulic cylinder C is a standard purchase piece of equipment having a movement from left to right of a sufficient distance, e.g., about 5 ½ inches, to accommodate the movement of the switch points in response to the switch rods. Of course this may vary by using gearing or a leveraged action but such is not necessary. The hydraulic cylinder C includes a body 50 with a rod 50*a* connected to a piston 50*b* located within body 50. The piston 50*b* separates the left fluid zone 50*c* and the right fluid zone 50*d* which are alternately pressured through the operation of the system S through the flow of hydraulic fluid from the hydraulic pump 10.

Further, the entire assembly shown in FIG. 1 is commercially available in a compact package. For example, such assemblies are available from Fenner Fluid Power, Rockford Ill., such as its Distributor Unit, Part No. DC-30. Accordingly, this assembly shown in FIG. 1 may be built or bought as a single unit.

Referring now to FIG. 3, in order to translate the motion of the piston rod 50*a* to operate the switch points, there is provided a main pivot shaft 51 having a first tab 52, a second tab 53 and a third tab 54. Tabs 51, 52 and 53 are preferably attached to the main pivot shaft substantially perpendicular to the axis of the main pivot shaft. One end of piston rod 50*a* is pivotally attached to the first tab 51. The connector 55 or switch rods is pivotally attached to the second tab 53. Movement of the piston rod 50*a* along its axis causes the main pivot shaft 51 to rotate about its axis. The rotation of the pivot shaft 51 causes the connector 55 to move along its axis, thereby operating the switch points in response to movement of the piston rod 50*a*. Once in position, the piston rod 50*a* is held at its extended or retracted position mechanically through the operation of the lock L which comprises a biasing spring 56 with one end 58 pivotally attached to a fixed location in the switch stand and the other end 59 pivotally attached to the third tab 54 which is urged into a locking position by the spring 56. Once the piston rod 50*a* moves the switch points and is locked in position through the action lock L, the DC power source is disconnected from the hydraulic pump and the hydraulic fluid in the piston 50 is allowed to depressure by allowing the hydraulic fluid to leakoff into the reservoir R.

Figure 2B:
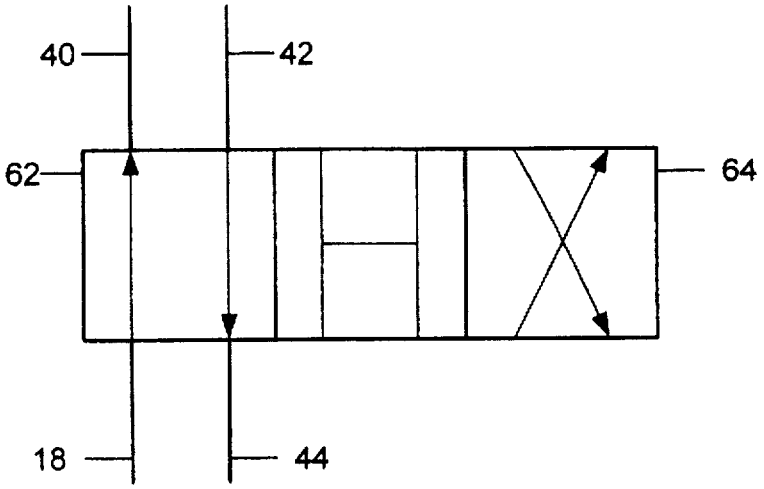
FIG. 2*b* is a schematic diagram showing the directional control valve in position to move the operating rod (also known as a piston rod) to the right.

The flow of hydraulic fluid into the reservoirs of hydraulic cylinder C to operate the switch is controlled by directional valve 60 which is a readily available commercial item which is shown FIG. 1 in schematic form in a neutral position as shown in more detail in FIG. 2*a*. Line 16 receiving high pressure hydraulic fluid from hydraulic pump 10 connects to branch 18 providing a high pressure source of hydraulic fluid to the paths of valve 60. To move the piston 50*b* of the hydraulic cylinder C to the right, valve 60 is shifted to the right as shown in FIG. 2*b* such that the left operating segment 62, having parallel paths 62*a* and 62*b*, are in position for alignment of flow through line 18 and 44.

In the position of the valve 60 where the hydraulic cylinder C moves the rod 50*a* to the right (see valve 60 flow configuration in FIGS. 2*b* and 3), the hydraulic fluid in branch 18 flows through parallel path 62*a* into line 40 which empties into the left reservoir 50*c* of hydraulic cylinder C thus causing the rod to move to the right expelling hydraulic fluid from reservoir 50*d* through line 42 and parallel path 62*b* to line 44 which directs the hydraulic fluid toward the reservoir R through line 26. The hydraulic fluid is stored in the reservoir R for uses as described above. When movement of the rod 50*a* ceases, valve 60 is returned to the neutral position (FIG. 2*a*) and the spring 56 of the locking system L to lock the connector 55 and thus hold the switch points in the desired position. The position of the connector 55 and the spring 56 after completing the movement to the right as described above is shown in FIG. 4.

Figure 2C:
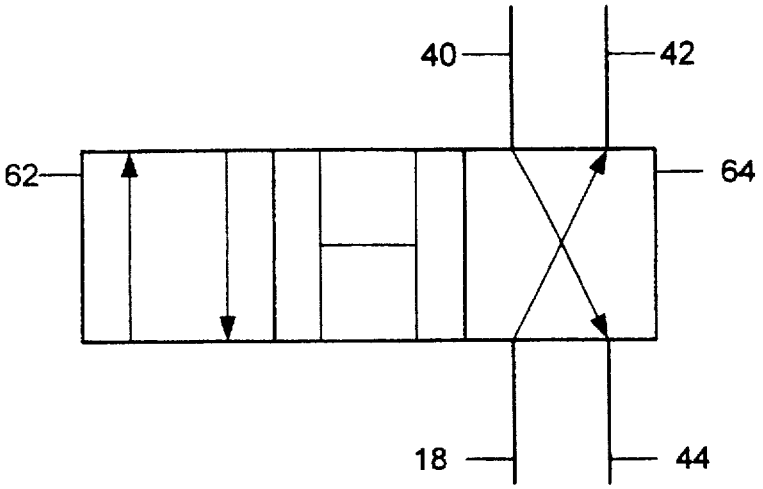
FIG. 2*c* is a schematic diagram showing the direction control valve in position to move the operating rod to the left.

When it is desired that the piston rod 50*a* move to the left, the valve 60, preferably a DC solenoid valve, is operated to move to the left position as shown in FIGS. 2*c* and 4. Then hydraulic fluid flow occurs through line 18 and transverse line 64*a* into line 42. Flow in line 42 exits into hydraulic fluid chamber 50*d* where the pressure increases and causes the rod 50*a* to move to the left dispelling fluid from the fluid chamber 50*c* through tine 40 and transverse line 64*b* into line 44 and returns as described above to the reservoir R through lines 44 and 26. Upon completion of movement to the left, the valve 60 is returned to the neutral position (as shown in FIG. 2*a*) thus neutralizing the pressure and allowing the spring 56 to the lock the position of the connector 55 of the hydraulic switch stand. The position of the connector 55 and the spring 56 after completing movement to the left as described above is shown in FIG. 3.

Figure 5:
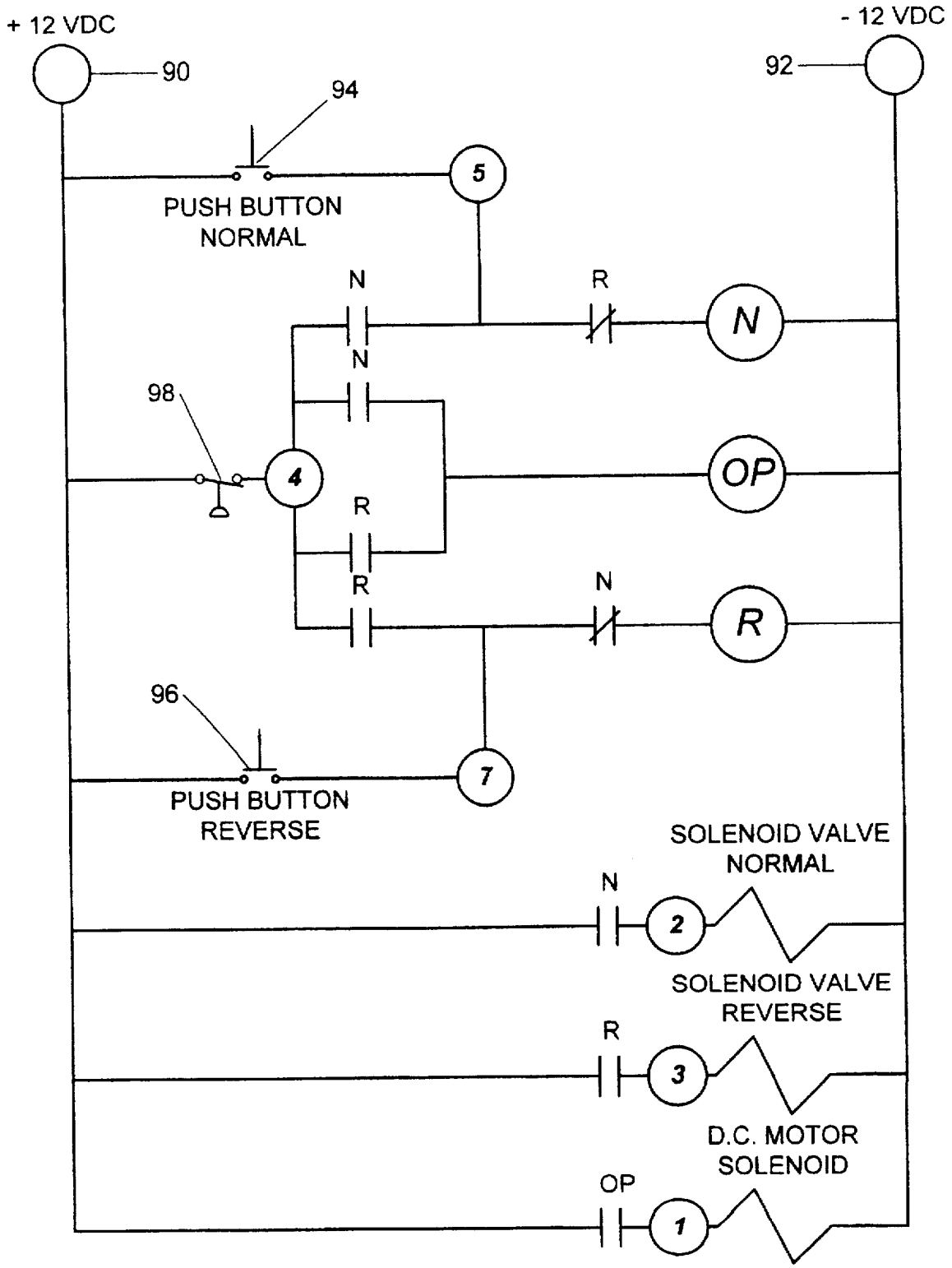
FIG. 5 is an electrical schematic of an embodiment of the present invention.

In FIG. 5, there is shown an electrical schematic for operating the switch apparatus shown in FIG. 1. The electrical requirements for the present invention are supplied by a DC power source, preferably a rechargeable battery 70 (see FIG. 6), e.g., a 12 volt battery. The battery 70 is connected to locations 90(+12 VDC) and 92(−12 VDC). Push buttons 94 and 96 are for activating the DC motor M and effecting a change in the solenoid valve 60 to effect movement to the right (normal movement) or to the left (reverse movement). Pressure switch 98 is a normally closed switch and as shown in FIG. 3 it senses the high pressure side or discharge pressure of the hydraulic pump 10. This switch 98 opens if it senses a pressure higher than a predetermined upper limit or set point. By opening, switch 98 disconnects the battery 70 from the DC motor M. FIG. 1 also shows an adjustable relief valve which may bleed off excess pressure to further protect the hydraulic fluid circuit. Terminal blocks for wire connections are designated by the number 1, 2, 3, 4, 5 and 7 in the circles shown. Designations N, R and OP in FIG. 5 are relays and stand for normal (N), reverse (R) and operate (OP). The DC motor M has a solenoid (not shown) as part of its starting assembly and is connected at point 1. The solenoids of the directional valve 60 are connected to points 2 and 3.

Figure 6:
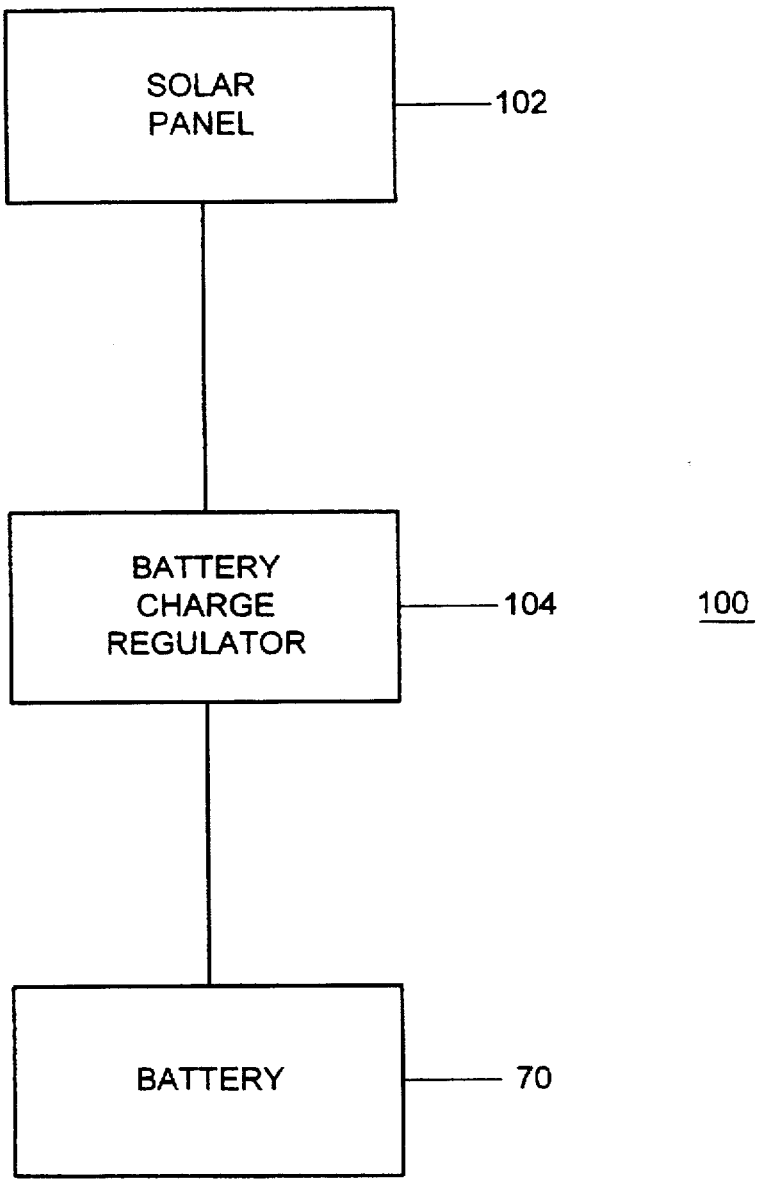
FIG. 6 is a simplified drawing of a solar panel, battery charging regulator and rechargeable battery in an embodiment of the present invention.

The present invention preferably includes a solar charging system 100 as depicted schematically in FIG. 6. The solar charging system 100 includes at least one solar panel 102 which is electrically connected to a battery charging regulator 104, which in turn is electrically connected to the rechargeable battery 70. Each of these components are commercially available. Since solar panels are non-mechanical there are no parts to wear out or breakdown. The panels (or modules as they are sometimes referred to) are also readily paralleled should power requirements increase. Such solar panels are available, for example, from Hutton Communications Solar Power, Dallas, Tex. An example of such a solar panel is Part Number PC-21F (17.0V, 2.0 amp, Procharger module with aluminum frame and junction box).

The rechargeable battery 70 is also available commercially. Sealed lead acid batteries are preferred. These are rugged, no spill storage batteries which are designed to be easily rechargeable and to provide steady power over an extended period of time. In the case of switch stands, the need is for reliable power due to the sometimes high incidence of switching required. Batteries for solar applications preferably have an electrolyte which is formulated for the solar charge, discharge cycle to provide superior life and performance over conventional sealed batteries. An example of such a battery is Part No. GC12V100B (sealed lead acid battery for solar applications, 12V, 90 AH) available from Hutton Communications Solar Power.

The battery charger regulator 104 is also available commercially. The regulator 104 is sized according to the amount of current the solar panel(s) 102 produces. The purpose of the regulator 104 is to regulate the charging of the battery 70, making sure the solar panel(s) 102 does not overcharge the battery 70. Keeping the battery properly charged will increase its life. In addition, the regulator 104 has reverse current protection which prevents the battery 70 from discharging at night. Some of these regulators may also have added features such as low voltage disconnect (LVD), preventing deep discharge from occurring and temperature compensation. Hutton Communications Solar Power also provides such regulators 104, for, example, Part No. ASC-12/8 (12V, 8 amp, charge control).

As noted above, the foregoing hydraulic switch stand can be assembled from readily acquired, commonly available components from supplies well known to those skilled in the art. Many variations of the components are available and can be used without departing from the scope and content of the foregoing description which amounts to the best mode for practicing this invention known to the inventor.

As shown in FIG. 5, the system may be operated using push buttons at the stand or hardwired remotely therefrom. Alternatively or in addition thereto, the system may be operated by remote control using an infrared controller or a radio controller as will be readily appreciated by one skilled in the art once apprised of this invention.

Thus, having described the foregoing invention, one skilled in the art would be enabled to practice the invention and know of the best mode for such practice contemplated by the inventor herein. Also one having such skill would readily understand many variations and changes which could be made in the above system without departing from the scope and content thereof.

What is claimed is:

1. An apparatus for moving railroad switch points from side-to-side, the apparatus comprising:

a pivot shaft;

a connecting rod having a first end operatively connected to the pivot shaft and a second end operatively attached to the switch points such that movement of the connecting rod along its axis moves the switch points from side-to-side;

a hydraulic cylinder having an operating rod that has a first end operatively connected to the pivot shaft and a second end connected to a piston internally disposed in the hydraulic cylinder, the piston defining a portion of two separate pressurizeable chambers within the hydraulic cylinder;

a hydraulic power source in fluid communication with the pressurizeable chambers in the hydraulic cylinder;

a valve positioned in fluid communication between the hydraulic power source and each of the pressurizeable chambers in the hydraulic cylinder for selectively controlling the direction of movement of the operating rod of the hydraulic cylinder;

a biasing spring having a first end pivotally attached to a fixed point and a second end operatively attached to the pivot shaft, wherein movement of the operating rod along its axis causes a rotation of the main pivot shaft, which translates to movement of the connecting rod along its axis to effect switching of the switch points from side-to-side and wherein the biasing spring exerts a force against its connection to the pivot shaft to assist in the retraction or extension of the connecting rod and to lock the connecting rod in position after the operating rod has been extended or retracted.

2. The apparatus for moving railroad switch points from side-to-side, as set forth in claim 1, wherein the hydraulic power source comprises a hydraulic pump, a DC electric motor, and a battery having a stored electrical charge, wherein the hydraulic pump is mechanically connected to and driven by the DC electric motor and the DC electric motor is electrically connected to the battery for drawing the stored electrical charge from the battery.

3. The apparatus for moving railroad switch points from side-to-side, as set forth in claim 2, further comprising a solar energy charging system, wherein the solar energy charging system replenishes the electrical charge of the battery.

4. The apparatus for moving railroad switch points from side-to-side, as set forth in claim 3, wherein the solar energy system comprises at least one solar panel and a battery charge regulator, wherein the at least one solar panel is electrically connected to the battery charge regulator and the battery charge regulator is electrically connected to the battery.

5. The apparatus for moving railroad switch points from side-to-side, as set forth in claim 1, further comprising a pressure switch for sensing hydraulic fluid pressure, wherein in an over pressure situation where the pressure switch senses a hydraulic fluid pressure greater than a predetermined maximum the pressure switch disconnects a DC electric motor from a DC power source connected to the DC electric motor.

6. An apparatus for moving railroad switch points from side-to-side, the apparatus comprising:

a hydraulic cylinder having an operating rod that has a first end operatively connected to the switch points to move the switch points from side-to-side and a second end connected to a piston internally disposed in the hydraulic cylinder, the piston defining a portion of two separate pressurizeable chambers within the hydraulic cylinder;

a hydraulic power source in fluid communication with the pressurizeable chambers in the hydraulic cylinder, wherein the hydraulic power source at least includes a hydraulic pump, a DC electric motor, and a battery having a stored electrical charge;

a valve positioned in fluid communication between the hydraulic power source and each of the pressurizeable chambers in the hydraulic cylinder for selectively controlling the direction of movement of the operating rod of the hydraulic cylinder; and a solar energy charging system, wherein the solar energy charging system replenishes the electrical charge of the battery, and a pressure switch for sensing hydraulic fluid pressure, wherein in an over pressure situation where the pressure switch senses a hydraulic fluid pressure greater than a predetermined maximum, the pressure switch disconnects the DC electric motor from the battery, wherein the hydraulic pump is mechanically connected to and driven by the DC electric motor and the DC electric motor is electrically connected to the battery for drawing the stored electrical charge from the battery.

7. The apparatus for moving railroad switch points from side-to-side, as set forth in claim 6, wherein the solar energy charging system comprises at least one solar panel and a battery charge regulator, wherein the at least one solar panel is electrically connected to the battery charge regulator and the battery charge regulator is electrically connected to the battery.

* * * * *